US005417440A

United States Patent [19]

Barrie et al.

[11] Patent Number: 5,417,440

[45] Date of Patent: May 23, 1995

[54] BROADHEAD ARROW TIP

[76] Inventors: Robert Barrie; Bruce Barrie, both of #2 Knoll Dr., Waseca, Minn. 56093

[21] Appl. No.: 242,601

[22] Filed: May 13, 1994

[51] Int. Cl.[6] ..... F42B 6/08

[52] U.S. Cl. ..... 273/422

[58] Field of Search ..... 273/416, 419–422

[56] References Cited

U.S. PATENT DOCUMENTS

| | | | |
|---|---|---|---|
| 2,940,758 | 6/1960 | Richter | 273/422 |
| 3,741,542 | 6/1973 | Karbo | 273/422 |
| 3,910,579 | 10/1975 | Sprandel | 273/422 |
| 4,036,499 | 9/1977 | Sherwin . | |
| 4,146,226 | 3/1979 | Sorensen | 273/422 |
| 4,210,330 | 7/1980 | Kosbab | 273/422 |
| 4,341,391 | 7/1982 | Anderson | 273/422 |
| 4,410,184 | 10/1983 | Anderson | 273/422 |
| 4,529,208 | 7/1985 | Simo | 273/422 |
| 4,676,512 | 6/1987 | Simo | 273/422 |
| 4,831,866 | 5/1993 | Simo | 273/422 |
| 4,986,550 | 1/1991 | Segovia | 273/422 |

*Primary Examiner*—Paul E. Shapiro

[57] ABSTRACT

A broadhead arrow tip for placement on the end of an arrow shaft for positively positioning any number of replaceable blades and positively holding the blades within the tip body in proper alignment with the longitudinal axis of the arrow shaft. A positive locking collar, of selectable length and of various materials, is provided between the arrow shaft ferrule and the tip body with such collar and body and ferrule having formed surfaces to lock and removeably retain the blades in the body. The length of the collar as well as the material used therefore is selectable such that the weight of the tip is controllable. The forward, tip end, of the body is undercut to receive and retain the forwardly directed tips of the individual blades.

20 Claims, 5 Drawing Sheets

BROADHEAD ARROW TIP

RELATED APPLICATIONS

There are no applications currently on file in the United States Patent Office by the inventor hereof which relate to this application.

SPONSORSHIP

This invention has not been made under and any Federally or otherwise sponsored research and development program.

FIELD OF THE INVENTION

This invention relates to broadhead arrow tips having removeable and replaceable blades with the tip being positively, longitudinally aligned with the arrow shaft into which it is mounted including a single angled, straight back, dual angled, convex or concave locking collar to lock against the shaft ferrule and the arrow tip. The length of such collar and the material thereof is also selectable for control of tip weight.

SUMMARY OF THE INVENTION

A broadhead arrow tip which includes a locking collar, a blade holding body and a front, penetrating tip portion. An arrow shaft is normally provided with a ferrule into which the body is threadably inserted. The body is provided with an angled rear surface and the ferrule is provided with a frontal, longitudinally disposed angled surface. The locking collar is provided, in one form, with a front and a rear angled surface to mate respectively with the angled surface of the ferrule and the angled surface of the tip body; in another form an angled rear surface and a radially straight frontal surface and in yet another form, convex or concave rear surfaces with angled or radially straight frontal surfaces.

This combination of angled, straight and curved surfaces provides a positive, longitudinal alignment of the broadhead tip body to the axis of the arrow shaft.

The locking collar, of any of the desired forms, is provided to be of selective length and material whereby the ultimate weight of the arrow tip may be adjusted to be within desirable limits.

The forwardmost tip of the broadhead body is provided with an undercut to receive the forward end of removeable blades and the collar, in any form, is designed to lock the rearward end of the blades or simply to capture the blade within the body.

BACKGROUND AND OBJECTS OF THE INVENTION

The term broadhead as applied to arrows is well known in the archery art. Such arrows are commonly used in hunting and the concept of blade replaceability is well known in this art. The prior art statement accompanying this application illustrates the patented art on this subject and persons skilled in as well as practicing the art are well aware of the need for replacement of blades on such tips.

Applicants' invention is directed to a structure for positively locking the blade bearing body and thus the blades onto an arrow shaft in true, longitudinal alignment therewith. The combination of a shaft ferrule, locking collar and blade retaining body provides a positive locking force or blade capturing force and the selectability of locking collar shape, length and material allows for proper determination of tip weight and locking of blades into the tip.

It is therefore an object of the applicants' invention to provide an improved broadhead arrow tip assembly to positively lock a blade bearing arrow tip or body to an arrow shaft.

It is a further object of the applicants' invention to provide an improved broadhead arrow tip assembly which permits ease of interchange of blades through a combination of angularly, convex, concave and straight surfaces to receive, capture and lock both the front and rear ends of the blades.

It is a further object of the applicants' invention to provide an improved broadhead arrow tip assembly for interchange of and replacement of individual blades for such tip which includes angularly, convex, concave and straight surfaces between the shaft ferrule, a locking collar and the blade receiving body.

These and other objects and advantages of the applicants' invention will more fully appear from a consideration of the accompanying drawings and disclosure.

DESCRIPTION OF THE INVENTION

Figure 1:
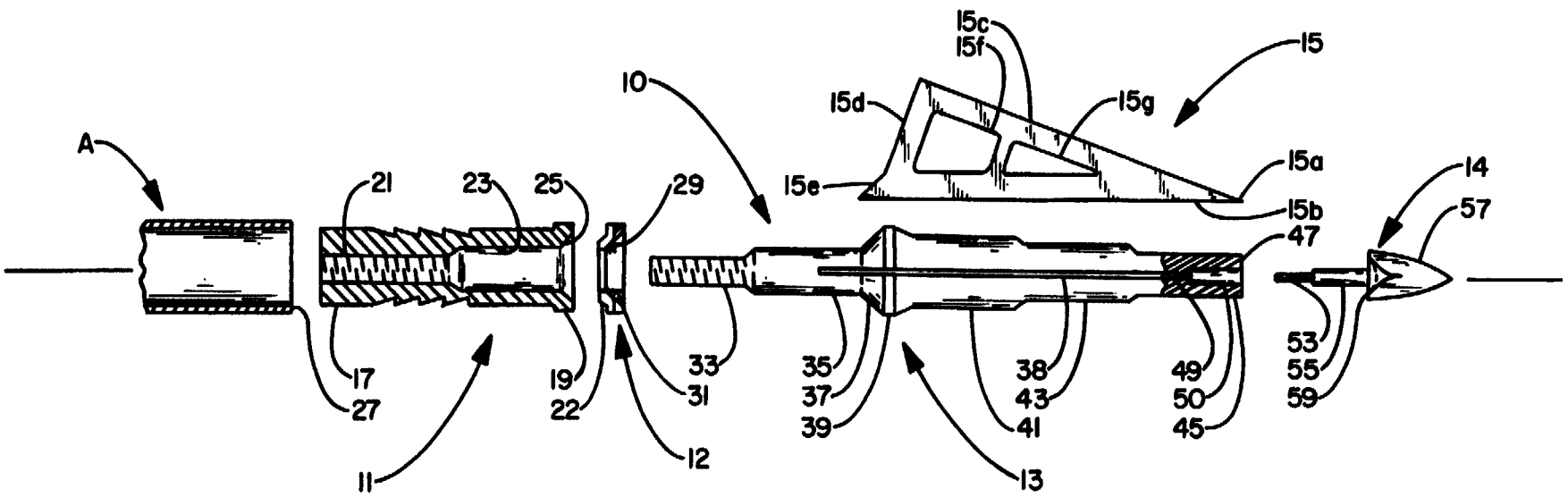
FIG. 1 is an exploded view of the broadhead arrow tip embodying the concepts of the applicants' invention and including one form of the locking collar that may be utilized in such tip, such view including the body slot for the blade.

In accordance with the accompanying drawings, the arrow tip embodying the concepts of the invention is generally designated 10 and includes an arrow shaft A, a tip mounting ferrule 11, a locking collar 12, a blade mounting body 13, penetration tip 14 and at least one removeable blade 15. The arrow shaft A normally consists of a hollow, aluminum shaft and the entire body 10 including the tip 14 is affixed thereto by threaded attachment to ferrule 11.

As illustrated, insert ferrule 11 is arranged and constructed to be pressed into the hollow arrow shaft A and a plurality of gripping, radially extending notches 17 arranged on the exterior thereof to prevent removal thereof from the shaft A. Similarly, insert ferrule 11 may be secured to Shaft A by providing adhesive within the notches 17. Insert ferrule 11 includes a forward shoulder 19 which abuts against the end of shaft A and an internal passage is provided within insert ferrule 11 to receive one end of blade body 13. This passage, as illustrated, includes a threaded portion 21 and a minimal clearance portion 23. The forward end 25 of clearance passage portion 23 is angularly arranged and serves as a seating and locking surface. Insert ferrule 11 is inserted into the end of the arrow shaft A and seated thereagainst with shoulder 19 abutting the forward shaft end 27. Insert ferrule 11 is of a length that it is retained in axial alignment with arrow shaft A and the minimal clearance portion 25 adds to axial alignment of body 13.

A first form of locking collar 12 is illustrated in FIGS. 1, 2, 3, 4 and 5 and, as shown, is of circular configuration and includes a rearwardly extending, angled, portion 22 to be received against forwardly directed anguled surface 25 of ferrule 11 to mate and lock thereagainst. The frontal area 29 of locking collar 12 is, in this form, rearwardly, angularly arranged to provide an angled, locking and mating surface for the rear end of blades 15 as well as a portion 37 of body 13, dependent upon blade length. Passage 31 is provided through locking collar 12 such that the arrow tip body 13 may pass therethrough into the passages 21, 23. Grooves **31*a* may be radially formed in the angled portion of the collar 12 which will permit radial compression of collar 12 against body portion 35**, providing a collet effect.

Figure 6:
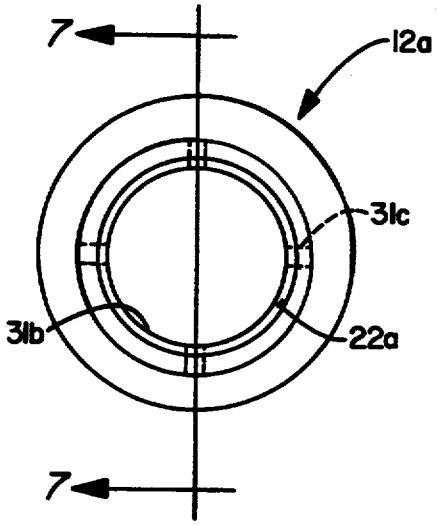
FIG. 6 is a view similar to FIG. 4 showing a modified, length adjustable, locking collar.
Figure 7:
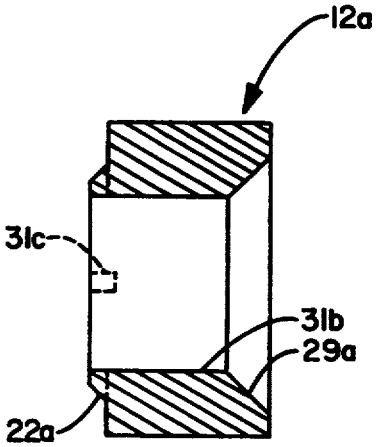
FIG. 7 is a cross section of the locking collar taken substantially along Line 7—7 of FIG. 6.

In a second form of the locking collar, FIGS. 6 and 7, the collar is designated **12*a*, the frontal or forward, angular surface 22*a*, the rear, angular surface 29*a* body passage 31*b* and compression (dotted line) radial slots 31*c*. Notably, the only difference between FIGS. 4 and 5 and 6 and 7 is the length of the collar 12 as compared to 12*a*. The collar 12*a* illustrates the applicants' concept of an adjustable length locking collar whereby the weight of the entire tip 10** may be adjusted simply by shortening the length of the collar. Again, weight adjustment may be arrived at by material selection.

The combination of the angled surfaces of ferrule 11 and locking collar 12 provide a self centering arrangement for these two elements and the rear **15*e* surfaces of blades 15 along with the angled rear surface 37 of blade body 13 provide additional angled, mating and locking surfaces such that when the body 13 is threaded into ferrule 11, with collar 12 therebetween, an axial alignment of all members is positively provided to arrow shaft A. Obviously, blades 15 are properly sized as to total length such that the collar 12, 12*a* will positively force the same into the undercut 59 of tip 14**.

Figure 2:
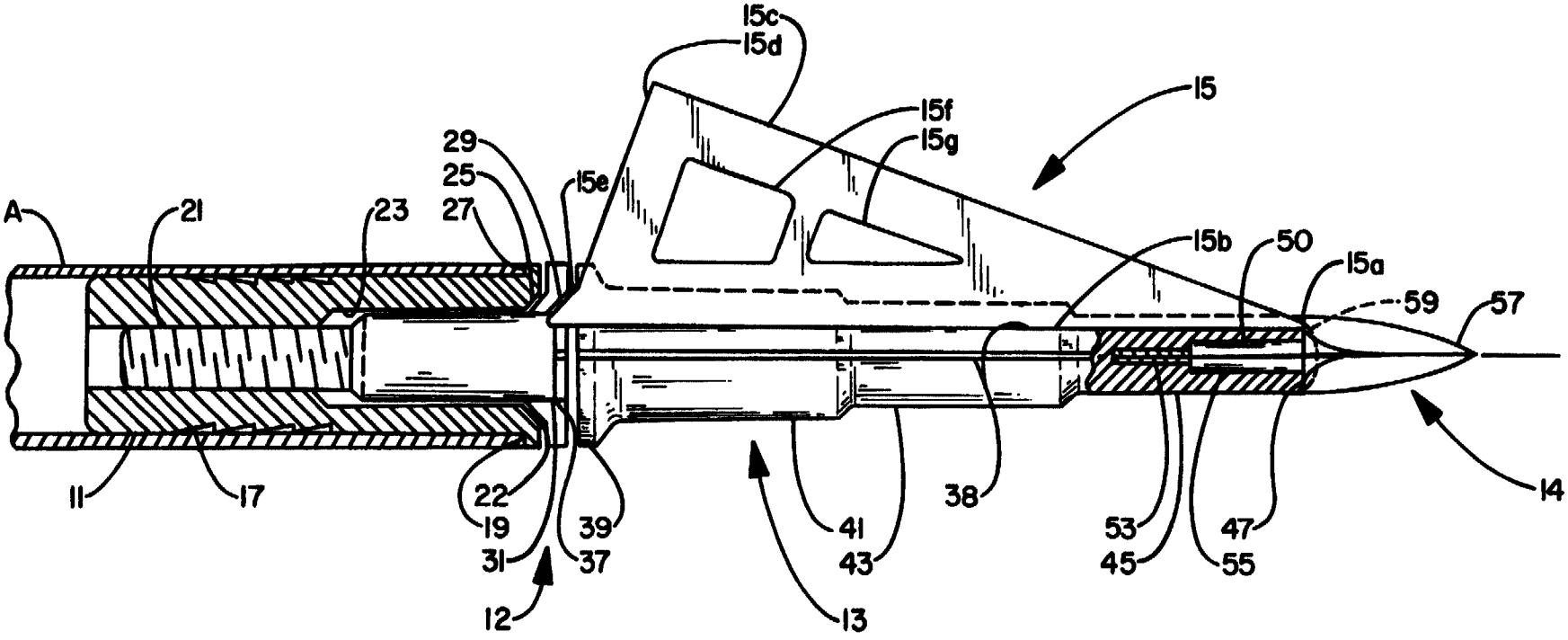
FIG. 2 is a cross section through an assembled arrow tip embodying the applicants' invention utilizing the elements of FIG. 1.
Figure 3:
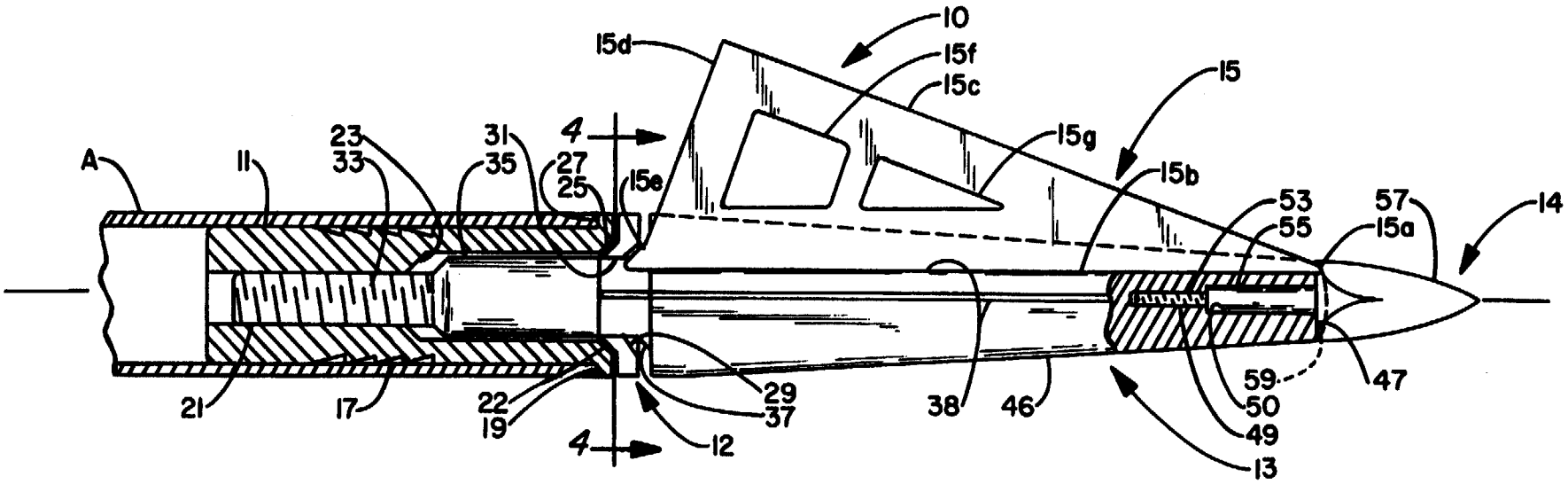
FIG. 3 is a view similar to FIG. 2 showing a modified body form of the invention again using the locking collar of FIG. 1.
Figure 4:
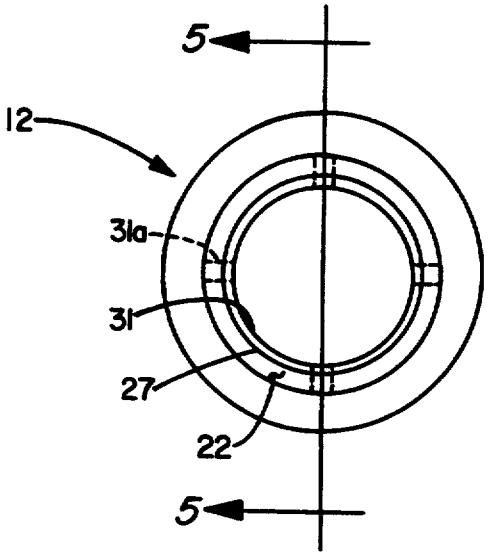
FIG. 4 is a section taken substantially along Line 4—4 of FIG. 3 and showing in dotted lines, a split, modified, configuration of a first, dual angled locking collar as illustrated in FIGS. 1, 2 and 3.
Figure 5:
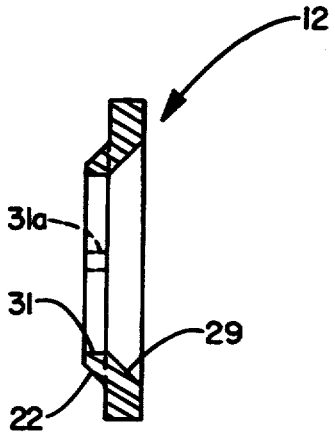
FIG. 5 is a cross section of the locking collar taken substantially along Line 5—5 of FIG. 4.

The blade holding body 13, as illustrated in FIGS. 1 and 2 provides a stepped unit while the body 13 of FIG. 3 provides a smoothly tapered unit.

The rear of body 13 provides a threaded portion 33 receivable into threaded passage 21 of ferrule 11 with an enlarged body section 35 being received into minimal clearance passage 23 of ferrule 11. As illustrated, the rearmost portion 37 of body 13 is tapered to receive collar 12, **12*a* thereagainst and, in the form shown, to agree with the rear angle 15*e* of blades 15. An enlarged, arrow shaft A diameter matching area 39 is provided at the forwardmost end of angled area 37 of the body and, as shown, blade receiving slots 38 extend from the forwardmost end 47 of body 13 through arrow shaft matching area 39 stepped areas 41, 43, 45 and into area 35**.

In a two piece body, the body tip 14 includes a threaded or unthreaded end 53, a slightly enlarged area 55 adjacent thereto with these areas being receiveable into threaded or unthreaded passage 49 and clearance passage 50 formed in the forwrd end 37 of body 13. The penetrating tip is designated 57 and may be conical or provided with flats. Immediately behind this penetrating tip 57, an undercut area 59 is provided to receive the forwardmost ends **15*a* of blades 15. It should be understood that the tip 14 may be included as an integral portion of the body 13** without departing from the scope of the invention.

The only difference in FIGS. 2 and 3 are the conical or tapered body shape 46 as compared to the stepped body shape, again, the same reference indicia being used to designate the same or similar parts in the views.

Blades 15 illustrated are typical of broadhead, replaceable blades. Each includes a frontal end **15*a* to be received into the undercut 59 of the tip 57, a bottom 15*b* receivable into the slots 38 and a sharpened edge 15*c*. As illustrated, these blades are triangular in shape and include a first rear, downwardly sloping, high angle portion 15*d* and a rear end portion 15*e* of sligthly less angle to agree with, in the form shown, the rearward surface 37 of body 13 and the forwardly directed angled surface 29*a* of collar 12. In this manner, force exerted by the angularly surfaced collars 12, 12*a* will hold the blade 15 between the collar 12, 12*a* and the undercut 59 of tip 14. Weight reducing and surface reducing areas 15*f*, 15*g* are provided within the bounds of blades 15**.

It has been found that the angles for the various elements may be between 30 and 60 degrees with the optimum angle being 45 degrees.

Figure 8:
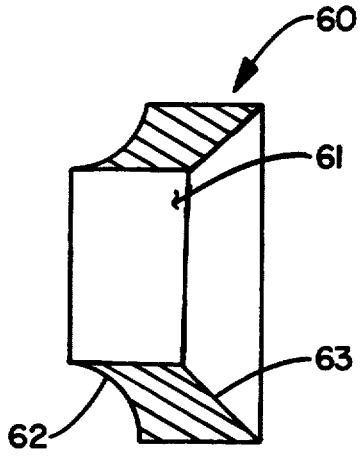
FIGS. 8, 9 and 10 are, respectively, cross sections of convex, concave and single angled-straight front, locking collars, all of which are useable in the arrow tips illustrated in FIGS. 1, 2 and 3.
Figure 9:
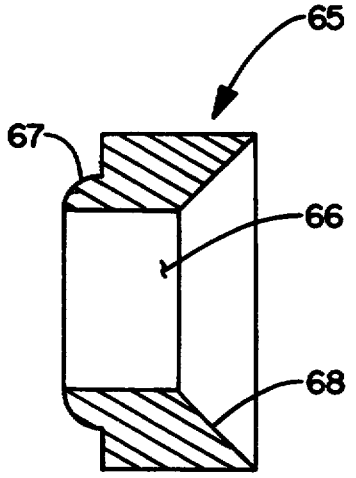
Figure 10:
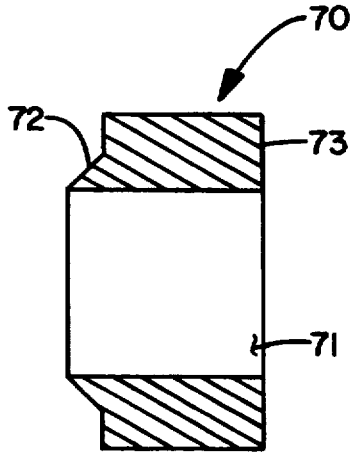

Several alternative forms of locking collar are illustrated in FIGS. 8, 9 and 10.

FIG. 8 locking collar is designated in its entirety 60 and includes a body passing passage 61, a rearwardly directed concave surface 62 and a forwardly directed angled surface 63. The outer diameter of such collar 60 will be, as illustrated in FIGS. 1, 2 and 3, equal to the shoulder diameter 19 of ferrule 11. With this forwardly directed angled surface 63, it should be obvious that the blade 15 may be of the shape illustrated in FIG. 1 wherein the rearward angle **15*e*** provides the interlock and blade capturing area.

FIG. 9 locking collar is designated in its entirety 65 and again provides a body passing passage 66, a rearwardly directed concave surface 67 and a forwardly directed angled surface 68. Again, the outer diameter of such collar 65 is of a size to agree with the arrow shaft diameter and shoulder 19 of ferrule 11.

FIG. 10 locking collar is designated in its entirety 70 and provides a body passing passage 71 therethrough with a rearwardly directed angular surface 72 and a radially straight frontal, blade abutment surface 73.

To accomodate a radially straight collar end, the rear surface **15*e* of a blade 15** is radially arranged rather than angularly arranged as shown. It is not thought to be necessary to show such a blade modification as such description should be sufficient.

It should also be obvious that any of the other locking collars as illustrated could be provided with this radially straight surface rather than an angular surface to abut with blade ends **15*e* and body surface 37**.

It has been stated that the ferrule 11 is normally provided with the angular, forwardly directed surface 25. Applicants have found that an angular surfaced, convex or concave surface on the rearward end of the various locking collars will effectively abut with such angled surface 25 and hold longitudinal alignment of the collar and body to the arrow shaft.

As stated, the angularity of the discussed surfaces may be between 30 and 60 degrees with the optimum angle being 45 degrees.

As stated, a primary aspect of the invention is to provide a positive locking, cooperative surface arrangment between certain of the elements of the unit. The collar may be resilient, deformable and collapsible for positively locking the blade and ferrule together and holding the blades into the body. Radial collapsibility to achieve a collet effect is increased with the radial slots being formed therein. As these elements are normally incompressible, they do depart from the prior art and, again, a further departure from the prior art is provided with the options of length and material, such as plastics and composites and thus weight of the collar being selectable to control final tip weight.

It should be obvious that the applicants have provided herein a new and unique locking and positioning arrangment for the elements of a broadhead arrow tip having replaceable blades.

What is claimed is:

1. A broadhead arrow tip for placement into an arrow shaft which shaft is provided with an internal ferrule, the ferrule having a rearwardly directed angular surface at its forwardmost end, a threaded passage and a clearance passage, the tip including:

a. a blade receiving body having:

1. longitudinally extending slots to receive blades therein;
2. a first reduced portion to be received into said clearance passage;
3. a threaded end to be received into said ferrule threaded passage;
4. a rearwardly directed angular surface adjacent said first reduced portion;
5. a penetrating tip in spaced relation to said rearwardly directed angular surface having an undercut to receive a forward end of a blade therein; and, b. a locking collar having a front and a rear end receivable about said first reduced body portion having:

1. a first rearwardly directed formed surface on said rear end to abut with the ferrule angular surface;
2. a second formed surface on said front end arranged and constructed to capture the rearward end of a received blade.

2. The broadhead arrow tip as set forth in claim 1 wherein said formed surface at said front end of said collar provides a rearwardly directed angular surface to abut with the rearward end of a received blade whereby a blade is positively locked into said body upon said body being threadably inserted into the ferrule.

3. The broadhead arrow tip as set forth in claim 2 wherein said angle to the arrow shaft axis is between 30 and 60 degrees.

4. The broadhead arrow tip as set forth in claim 1 wherein said formed surfaces of said collar are angularly arranged at an angle to the arrow shaft axis.

5. The broadhead arrow tip as set forth in claim 3 wherein said angle to the arrow shaft axis is 45 degrees.

6. The broadhead arrow tip as set forth in claim 1 wherein said first rearwardly formed surface at said rear end of said locking collar describes a concave surface.

7. The broadhead arrow tip as set forth in claim 6 wherein said second formed surface of said locking collar is a rearwardly directed angular surface.

8. The broadhead arrow tip as set forth in claim 7 wherein the angle of said rearwardly directed surfaces is between 30 and 60 degrees.

9. The broadhead arrow tip as set forth in claim 8 wherein said angle is 45 degrees.

10. The broadhead arrow tip as set forth in claim 6 and said second formed surface of said locking collar is at a right angle to the arrow shaft.

11. The broadhead arrow tip as set forth in claim 1 wherein said first rearwardly formed surface of said locking collar describes a convex surface.

12. The broadhead arrow tip as set forth in claim 11 wherein said second formed surface of said locking collar is a rearwardly directed angular surface.

13. The broadhead arrow tip as set forth in claim 12 wherein the angle of said rearwardly directed surface is between 30 and 60 degrees.

14. The broadhead arrow tip as set forth in claim 12 wherein said angle is 45 degrees.

15. The broadhead arrow tip as set forth in claim 11 wherein said second formed surface of said locking collar is at a right angle to the arrow shaft.

16. The broadhead arrow tip as set forth in claim 1 wherein the longitudinal length of said locking collar is selectable whereby the weight of the arrow tip is controllable.

17. The broadhead arrow tip as set forth in claim 1 wherein the material of said locking collar is selectable whereby the weight of the arrow tip is controllable.

18. The broadhead arrow tip as set forth in claim 1 wherein:

a. said first formed surface of said locking collar is at an angle to the arrow shaft axis between 30 and 60 degrees; and, b. said second formed surface of said locking collar is at right angles to the arrow shaft axis.

19. The broadhead arrow tip as set forth in claim 18 wherein said angle of said first formed surface is at 45 degrees to the arrow shaft axis.

20. The broadhead arrow tip as set forth in claim 1 wherein radial slots are provided in said first rearwardly directed surface of said locking collar whereby said surface is radially collapsible against said body.

* * * * *